United States Patent [19]

Turano

[11] 4,334,416

[45] Jun. 15, 1982

[54] CONTAINER FOR SOAKING AND PRESERVING PAINT ROLLER COVERS

[76] Inventor: Peter S. Turano, 424 Argonne Dr., New Kensington, Pa. 15068

[21] Appl. No.: 262,333

[22] Filed: May 11, 1981

[51] Int. Cl.[3] ..... D06F 1/12; D06F 3/00

[52] U.S. Cl. ..... 68/213; 134/149; 134/117; 206/207

[58] Field of Search ..... 206/209, 361, 207; 68/213; 134/135, 117, 138, 139, 149; 220/288

[56] References Cited

U.S. PATENT DOCUMENTS

| | | | |
|---|---|---|---|
| 2,704,931 | 3/1955 | Zelkowitz | 68/213 |
| 2,766,603 | 10/1956 | Zelkowitz | 68/213 |
| 3,918,582 | 11/1975 | Wallace | 206/362 |

*Primary Examiner*—William Price
*Assistant Examiner*—B. J. Ehrhardt
*Attorney, Agent, or Firm*—Carothers and Carothers

[57] ABSTRACT

A sealable container for paint dissolving and cleaning fluids for storing and cleaning a paint roller cover sleeve. A central post having an enlarged foot at the bottom thereof for engaging the inside bottom wall of the receptacle such that a paint roller cover is coaxially received over the post and rests on top of the bottom foot of the post to provide sediment clearance space at the bottom of the container and to additionally provide a handle at the top of the post for removing the post from the container together with the paint roller cover sleeve without having to directly handle the sleeve. A drain position is provided at the upper end of the container so that the foot of the post may rest at the drain position to permit the remaining fluids contained within the roller cover sleeve to drain back down into the container.

6 Claims, 2 Drawing Figures

CONTAINER FOR SOAKING AND PRESERVING PAINT ROLLER COVERS

BACKGROUND OF THE INVENTION

This invention relates generally to receptacles and more particularly to a receptacle for facilitating the cleansing and storage of fabric sleeves as used on a roller for applying paint and the like.

In the painting of walls, etc., a roll type applicator known as a paint roller generally is employed. The paint roller cover sleeves require proper cleaning and care between use if they are to be re-used. For example, if one employs a paint roller with oil base paint then fails to clean the same, the roller sleeve generally must be discarded and cannot be re-used.

In this connection, a number of receptacles have been devised for cleaning and storing paint roller sleeves. For example, U.S. Pat. No. 2,704,931 issued on Mar. 29, 1955 to Zelkowitz illustrates such a prior art receptacle. This is an effective device for cleaning paint roller sleeves, but requires direct handling contact with the wet paint roller by one's hand in order to remove the paint roller sleeve from the container. The receptacle further does not provide a means to permit the paint roller sleeve to be drained prior to removal from the container. This latter-indicated problem is also apparent with the receptacle illustrated in U.S. Pat. No. 2,766,603 issued Oct. 16, 1956 to Zelkowitz, in that this container also provides no means of draining the solvent-soaked paint roller sleeve. However, this latter Patent does illustrate a container in which the paint roller sleeve does not have to be directly handled by hand contact when it is removed from the container. Nevertheless, this second Patent does provide some undesirable complexities in that when positioning the paint roller in the container, the sleeve cannot simply be dropped over a center post; it must be properly aligned and positioned before the container can be closed.

Another example of such prior art containers is illustrated in U.S. Pat. No. 3,917,582 issued Nov. 11, 1975 to Wallace. This Patent shows a receptacle which provides no means for handling or removing the solvent-soaked paint roller, as it is in reality adapted to clean implements other than paint rollers, such as paint brushes. Again, the device illustrated in this Patent has the same inherent disadvantages as previously mentioned.

SUMMARY OF THE INVENTION

The container of the present invention for soaking and preserving paint roller cover sleeves or the like comprises in combination, an open top receptacle having bottom and side walls for holding a quantity of solvent, and a removable cap for sealing the open top of the container, together with a post having an enlarged foot at the bottom end thereof for engaging the inside bottom of the receptacle to removably support the post in an upright position in the receptacle. The post is short enough to fit upright in the receptacle with the removable cap secured thereto, and is also small enough in diameter to receive a paint roller cover sleeve over the post such that it will rest on top of the enlarged foot of the post.

The post is longer in length than a paint roller cover sleeve to be treated or received coaxially over the post in order to provide an exposed upper portion of the post for grasping above the paint roller cover sleeve received coaxially end-wise over the post.

The enlarged foot at the bottom of the post supports the paint roller sleeve a spaced distance above the bottom wall of the container, thereby providing an area for thick paint residue to settle at the bottom of the container below the paint roller cover sleeve. The foot of the post is preferably configured of radially extending projections which provide space therebetween for the solvent and paint residue settlement to gather. In addition, the receptacle is also preferably provided with a plurality of circumferentially spaced and inwardly projecting ledges on the inside walls of the receptacle adjacent the upper open end thereof. Thus, the radially extending projections of the foot of the aforesaid post may selectively rest on or engage these ledges to support the post and its integral foot on the ledges in a drain position adjacent the top of the receptacle such that a paint roller cover sleeve received on the post would be supported for solvent drainage above a quantity of solvent contained in the receptacle.

Accordingly, a paint roller cover sleeve may be coaxially slid over the post such that it rests on the enlarged foot of the post and then one need only grasp the upper handle end of the post and lower the combination down into the solvent contained within the container. The lid is then secured to the top of the container and the whole unit may be shaken to thoroughly cleanse the paint from the paint roller sleeve. The paint roller cover sleeve may be thus stored in the container until use is required. The heavy paint sediment settles to the bottom around the foot of the post supporting the paint roller cover sleeve.

When use of the roller cover sleeve is desired, the top cover is removed and the top of the post may be grasped and raised together with the paint roller cover sleeve such that the radial projections of the foot of the post are positioned so that the post may be pulled upwardly whereby the radial projections of the foot can be pulled past the inwardly projecting ledges on the inside walls of the receptacle adjacent the upper open end of the receptacle, and then the foot may be repositioned to rest on these ledges to support the paint roller cover sleeve above the open end of the container for draining. In this drain position, one may also utilize a paint roller scraper against the roller sleeve surface to encourage drainage of the solvent from the paint roller cover sleeve down into the underlying container. After the paint roller cover sleeve has been thoroughly drained and removed from the post, the post may be reinserted into the container and the lid replaced to prevent evaporation of the solvent contained therein for use at a later time.

A plurality of circumferentially spaced and inwardly facing lugs may be provided on the inside walls of the receptacle adjacent the bottom end thereof and positioned to engage the top of the aforesaid radially extending foot projections when they are rotated into position by these center posts such that the projections are positioned under the lugs to lock the foot into engagement with the inside bottom wall of the receptacle, so that the post is held stationary within the receptacle. These latter-mentioned lugs may extend circumferentially downward a short span in the fashion of a screw thread such that they increasingly engage the top of the foot projections when rotated into position thereunder to clamp the foot against the inside bottom wall of the receptacle.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
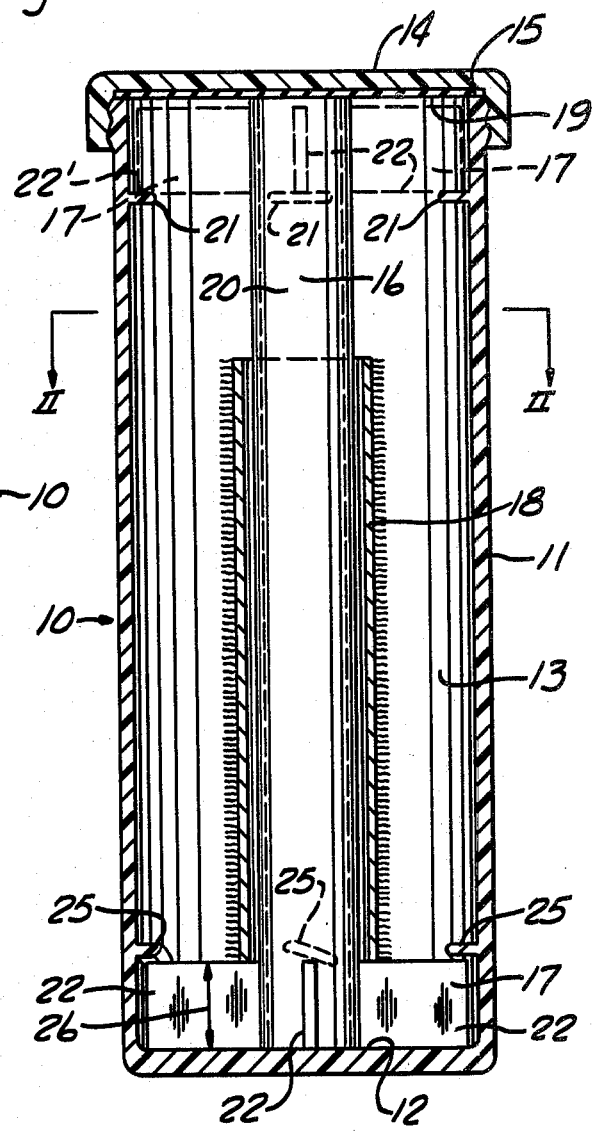
FIG. 1 is a view in side elevation in vertical medial cross section through the receptacle and the paint roller cover sleeve contained therein, with the paint roller sleeve support post and foot illustrated in full.
Figure 2:
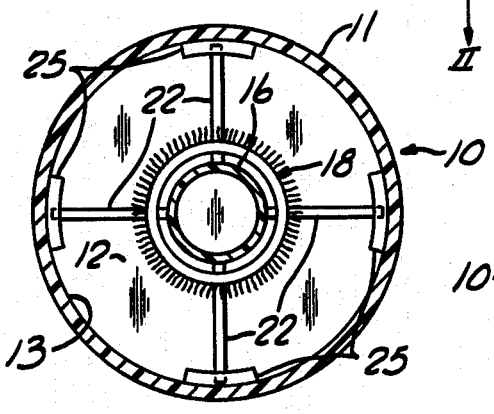
FIG. 2 is a view in transverse cross section taken on line II—II of the container or receptacle illustrated in FIG. 1.

Referring to FIGS. 1 and 2, the container 10 of the present invention for soaking and preserving a paint roller cover sleeve or the like comprises an open top receptacle 11 having a bottom wall 12 and cylindrical side wall 13 for holding a quantity of solvent (not shown) therein. The solvent is not illustrated within the container for ease of illustration. However, generally the solvent contained therein will be paint thinner, water or another solvent, and it will be added to the container 10 or receptacle 11 to the level of section line II—II.

A removable cap 14 is threadably received on the top of receptacle 11 for sealing the open top 15 of the receptacle.

Post 16 is provided with an enlarged foot 17 at the bottom end thereof for engaging the inside bottom wall 12 of receptacle 11. Enlarged foot 17 is secured to the bottom of post 16 and thus supports the post 16 in an upright position in receptacle 11 as illustrated. Post 16 is short enough to fit upright in receptacle 11 with removable cap 14 secured thereto, and yet is small enough in diameter to receive paint roller cover sleeve 18 thereover, as illustrated.

In fact, removable cap 14 is provided with rubber seal disc 19 therein to provide an insured liquid seal between cap 14 and the top 15 of receptacle 11, and post 16 is made to exact length so that rubber disc 19 also centrally engages the top of post 16 to securely retain post 16 within receptacle 11 against vibrating noises when the entire container is shaken.

It should be noted that post 16 is longer in length than paint roller cover sleeve 18 in order to provide an exposed upper portion 20 of post 16, above paint roller cover sleeve 18 received thereon, for grasping, so that one may lift the entire assembly consisting of cover sleeve 18, post 16 together with its integral foot 17 out of container 11 through the open top 15.

A plurality of circumferentially spaced and inwardly projecting ledges 21 are provided on the inside walls 13 of receptacle 11 adjacent the upper open end thereof. It should also be noted, that the enlarged post foot 17 consists of four radially extending projections 22 which, when properly positioned, may selectively engage the top of ledges 21 as indicated in the dashed outline 22' in FIG. 1, to support post 16 and its integral foot 17 on ledges 21 in a drain position adjacent the top of the receptacle, such that paint roller cover sleeve 18 on post 16 will be supported for solvent drainage above the quantity of solvent contained in the receptacle. In this position, the solvent contained within the sleeve 18 is permitted to drain by gravity back down into the receptacle 11 in order to save the same for re-use. Drainage of sleeve 18 may also be enhanced by the use of a scraper against the sleeve 18 while it is in the aforesaid drain position.

Since the four foot projections 22 are radially spaced, post 16 may be rotated either clockwise or counterclockwise when the post 16 is being raised to make certain that they clear the radially spaced projections 21 in order to entirely remove the post from receptacle 11 or to reposition the bottom of projections 22 on top of ledges 21 in the drain position.

The receptacle 11 is also provided with a plurality of circumferentially spaced and inwardly projecting lugs 25 on the inside walls 13 of receptacle 11 adjacent the bottom end thereof and are positioned to engage the tops of the aforesaid radially extending foot projections 22 when they are rotated into position under lugs 25 to lock foot 17 into snug engagement with the inside bottom wall 12 of receptacle 11. It should be noted that lugs 25 extend circumferentially downward a short span in a screw fashion such that they increasingly engage the top of the foot projections 22 when they are rotated clockwise into position under lugs 25 to clamp the foot against the inside bottom wall. These lugs 25 are not essential in view of the fact that cap 14 snugly secures post 16 against bottom wall 12 in any event. However, they are nevertheless desirable in that they retain post 16 within the container, when desired, even though cap 14 may be removed.

It should be further noted that foot 17 is of sufficient depth to support the paint roller cover sleeve 18 received on post 16 above the inside bottom wall 12 to provide a paint sediment settling space 26 at the bottom of receptacle 11 below the bottom end of paint roller cover sleeve 18 supported in the receptacle.

I claim:

1. A container for soaking and preserving paint roller cover sleeves or the like, comprising in combination, an open top receptacle having bottom and side walls for holding a quantity of solvent, a removable cap for sealing said open top, a post having an enlarged foot at the bottom end thereof for engaging the inside bottom of said receptacle to removably support said post in an upright position in said receptacle, said post being short enough to fit upright in said receptacle with said removable cap secured thereto and small enough in diameter to receive a paint roller cover sleeve thereover.

2. The container of claim 1, wherein said post is longer than a paint roller cover sleeve to be treated in order to provide an exposed upper portion of the post for grasping above a paint roller cover sleeve received thereon.

3. The container of claim 1, including a plurality of circumferentially spaced and inwardly projecting ledges on the inside walls of said receptacle adjacent the upper open end thereof, said enlarged post foot having radially extending projections for selectively engaging said ledges to support said post and foot on said ledges in a drain position adjacent the top of said receptacle such that a paint roller cover sleeve received on said post would be supported for solvent drainage above a quantity of solvent contained in said receptacle.

4. The container of claim 3, including a plurality of circumferentially spaced and inwardly projecting lugs on the inside walls of said receptacle adjacent the bottom end thereof and positioned to engage the tops of said radially extending foot projections when rotated into position thereunder to lock said foot into engagement with the inside bottom wall of said receptacle.

5. The container of claim 4, wherein said lugs extend circumferentially downward a short span such that they increasingly engage the top of said foot projections when rotated into position thereunder to clamp said foot against the inside bottom wall of said receptacle.

6. The container of claim 1, wherein said foot is an open rack structure of sufficient depth to support a paint roller cover sleeve received on said post above the inside bottom wall of said receptacle to provide a paint sediment settling space at the bottom of said receptacle below an end of a paint roller cover sleeve supported therein by said post.

* * * * *